US010858083B1

(12) United States Patent
Basta et al.

(10) Patent No.: US 10,858,083 B1
(45) Date of Patent: Dec. 8, 2020

(54) BUNK MOUNTING SYSTEMS AND METHODS FOR WATERCRAFT LIFTS

(71) Applicant: BASTA IP INC., Bellevue, WA (US)

(72) Inventors: Samuel T. Basta, Bellevue, WA (US); Gene Thompson, Bellevue, WA (US)

(73) Assignee: BASTA IP INC., Bellevue, WA (US)

( * ) Notice: Subject to any disclaimer, the term of this patent is extended or adjusted under 35 U.S.C. 154(b) by 11 days.

(21) Appl. No.: 15/877,272

(22) Filed: Jan. 22, 2018

Related U.S. Application Data

(60) Provisional application No. 62/449,100, filed on Jan. 22, 2017.

(51) Int. Cl.
*B63C 3/06* (2006.01)
*B63C 3/12* (2006.01)
*B63C 5/02* (2006.01)

(52) U.S. Cl.
CPC ..... *B63C 3/12* (2013.01); *B63C 5/02* (2013.01); *B63C 2005/025* (2013.01)

(58) Field of Classification Search
CPC ..... B63C 3/12; B63C 5/02; B63C 2005/025
USPC ..... 114/44–48; 405/3
See application file for complete search history.

(56) References Cited

U.S. PATENT DOCUMENTS 704,358 A 7/1902 McCullough
779,600 A 1/1905 Hickler
3,021,965 A * 2/1962 Harvey ..... B63C 3/06 414/678
3,088,545 A 5/1963 Meyer
3,275,167 A * 9/1966 Godbersen ..... B63C 1/10 414/680
3,362,172 A 1/1968 Rutter
3,632,138 A 1/1972 Whiteley
3,753,355 A * 8/1973 Knoch ..... B63C 3/06 405/3
3,841,442 A 10/1974 Erickson et al.
3,863,890 A * 2/1975 Ruffing ..... B66F 7/08 254/10 C
4,022,027 A * 5/1977 Tetzner ..... B63C 3/06 405/3
4,024,972 A 5/1977 Hobson
4,027,492 A * 6/1977 Carpenter ..... B63C 3/06 405/3
4,072,119 A * 2/1978 Williams ..... B63C 1/02 114/45
4,222,140 A 9/1980 Olewinski et al.
4,641,595 A 2/1987 Pritchett
1,671,729 A 6/1987 McFarland
4,678,366 A 7/1987 Williamson
(Continued)

FOREIGN PATENT DOCUMENTS

GB 694510 A 7/1953
GB 2099789 12/1982

*Primary Examiner* — Edwin J Toledo-Duran
(74) *Attorney, Agent, or Firm* — Seed IP Law Group LLP

(57) ABSTRACT

A bunk mounting system for a watercraft lift comprising a first support defining first and second legs, a second support defining third and fourth legs, and first and second bunks. The bunk mounting system has first and second crossbeams, pivot connectors, and rail connectors. The pivot connectors pivotably connect the first crossbeam to the first and second legs and the second crossbeam to the third and fourth legs. The rail connectors detachably connect the first bunk to the first and second crossbeams and the second bunk to the first and second crossbeams.

21 Claims, 12 Drawing Sheets

(56) References Cited

U.S. PATENT DOCUMENTS 4,787,327 A * 11/1988 Porter ..... B63C 3/06 114/44
4,832,280 A 5/1989 Haland et al.
4,850,741 A * 7/1989 Timmerman ..... B63C 3/06 405/3
4,895,479 A * 1/1990 Michaelsen ..... B63C 3/06 254/93 R
4,934,298 A 6/1990 Pritchett
4,973,094 A 11/1990 Tana et al.
4,983,067 A 1/1991 Montgomery
5,007,121 A * 4/1991 McEathron ..... A61G 7/1003 254/10 C
D317,790 S 6/1991 Hey
5,090,842 A 2/1992 Montgomery
5,131,342 A * 7/1992 Sackett ..... B63C 1/02 114/344
5,133,570 A 7/1992 Godbersen
5,143,182 A 9/1992 Basta
5,158,419 A 10/1992 Kempf et al.
5,184,913 A 2/1993 Meriwether
5,184,914 A * 2/1993 Basta ..... B63C 3/06 114/44
5,211,124 A 5/1993 Reiser
5,240,347 A 8/1993 Williams et al.
5,275,505 A 1/1994 Wilcox
5,311,970 A 5/1994 Basta
5,316,329 A 5/1994 MacKarvich
5,358,350 A 10/1994 Oertle
5,391,932 A 2/1995 Small et al.
5,485,798 A 1/1996 Samoian et al.
5,543,837 A 8/1996 Aoki et al.
5,620,154 A 4/1997 Hey
5,649,417 A 7/1997 Hey
5,678,663 A 10/1997 Watanabe et al.
5,687,663 A * 11/1997 Wahlstrand ..... B63C 3/12 114/44
5,725,181 A 3/1998 Hey
5,860,379 A 1/1999 Moody
5,860,623 A 1/1999 Dunstan et al.
5,888,019 A * 3/1999 Quastad ..... B63C 3/06 114/44
5,890,835 A * 4/1999 Basta ..... B63C 3/06 114/44
5,908,264 A * 6/1999 Hey ..... B63C 3/06 114/44
5,909,877 A 6/1999 Bour
5,919,000 A 7/1999 Unkle
6,076,478 A 6/2000 Siegmann
6,113,124 A 9/2000 Chambers
6,131,528 A 10/2000 Meek et al.
6,131,850 A 10/2000 Hey et al.
6,250,662 B1 6/2001 Poppell
6,318,929 B1 * 11/2001 Basta ..... B63C 3/00 114/44
6,453,837 B1 9/2002 Arbaugh et al.
6,543,837 B2 4/2003 Fischer et al.
6,575,661 B1 * 6/2003 Phillips ..... B63C 3/06 114/44
6,602,022 B1 8/2003 Wilkins
6,612,775 B1 * 9/2003 Hewitt ..... B63C 3/06 114/44
D484,086 S 12/2003 Davidson et al.
D484,450 S 12/2003 Davidson et al.
D487,423 S 3/2004 Davidson et al.
6,752,096 B2 6/2004 Elson et al.
6,752,097 B1 6/2004 Elson et al.
6,752,099 B1 6/2004 Crifase et al.
6,823,809 B2 11/2004 Hey
6,830,002 B1 * 12/2004 Walker ..... B63C 3/06 114/44
6,830,410 B2 12/2004 Davidson et al.
6,837,651 B1 * 1/2005 Basta ..... B63C 3/12 405/3
D503,692 S 4/2005 Basta
6,976,442 B2 12/2005 Hey et al.
7,021,861 B2 4/2006 Basta
7,210,420 B1 5/2007 Basta
7,226,041 B2 6/2007 Ledford
7,246,970 B2 7/2007 Hey
7,404,353 B2 7/2008 Kriegsmann
7,527,014 B2 5/2009 Hey et al.
7,587,971 B2 9/2009 Kriegsmann
7,712,425 B2 5/2010 Basta
8,388,265 B2 3/2013 Basta et al.
8,794,870 B2 8/2014 Basta et al.
8,979,426 B2 * 3/2015 Doig ..... B63C 3/06 405/3
10,059,412 B1 * 8/2018 Basta ..... B66F 7/08
2002/0132537 A1 * 9/2002 Hey ..... B63C 3/02 441/49
2004/0126185 A1 7/2004 Davidson et al.
2004/0184883 A1 * 9/2004 Basta ..... B66F 7/08 405/3
2005/0013663 A1 1/2005 Basta
2005/0016438 A1 1/2005 Hey et al.
2005/0123351 A1 6/2005 Basta
2005/0139141 A1 6/2005 Hey et al.
2005/0166821 A1 8/2005 McKenzie
2005/0183648 A1 8/2005 Basta
2005/0235893 A1 10/2005 Hey et al.
2005/0248120 A1 11/2005 McJunkin et al.
2005/0252542 A1 11/2005 Basta
2005/0260036 A1 11/2005 Emond
2006/0147268 A1 7/2006 Hey
2006/0147269 A1 * 7/2006 Spratt ..... B63C 3/06 405/3
2006/0153643 A1 7/2006 Basta
2006/0225635 A1 10/2006 Basta
2007/0045984 A1 3/2007 Remedios et al.
2007/0169675 A1 7/2007 Basta
2007/0295379 A1 12/2007 Basta
2008/0008528 A1 1/2008 Hey et al.
2009/0007770 A1 1/2009 Kriegsmann
2009/0190994 A1 7/2009 Hey et al.
2009/0191000 A1 7/2009 Kloster et al.
2009/0194014 A1 8/2009 Kloster et al.
2009/0202300 A1 8/2009 Basta
2009/0241824 A1 10/2009 Basta
2012/0224919 A1 * 9/2012 Basta ..... B66F 7/08 405/3

* cited by examiner

BUNK MOUNTING SYSTEMS AND METHODS FOR WATERCRAFT LIFTS

RELATED APPLICATIONS

This application claims benefit of U.S. Provisional Application Ser. No. 62/449,100 filed Jan. 22, 2017, the contents of which are incorporated herein by reference.

TECHNICAL FIELD

The present invention relates to watercraft lifts and, more particularly, to bunk mounting systems for watercraft lifts.

BACKGROUND

Boat lifts are often arranged in a body of water to raise the boat out of the water when not in use. Boat lifts may be supported on the bed of the body of water or by rafts, pontoons, or other floating structures.

Boat lifts may take many different configurations, but mechanical boat lifts typically comprise one or more bunk structures or bunk rails, often referred to simply as bunks, that engage the bottom of the boat when the boat is lifted. The bunks typically comprise a structural portion capable of transferring the weight of the boat to the boat lift and a cushioning portion that protects the bottom of the boat during lifting.

The need exists for bunks that may be reconfigured to accommodate a particular boat lift and a particular boat.

SUMMARY

The present invention may be embodied as a bunk mounting system for a watercraft lift comprising a first support defining first and second legs, a second support defining third and fourth legs, and first and second bunks. The bunk mounting system comprises first and second crossbeams, a plurality of pivot connectors, and a plurality of rail connectors. The plurality of pivot connectors pivotably connect the first crossbeam to the first and second legs and the second crossbeam to the third and fourth legs. The plurality of rail connectors detachably connect the first bunk to the first and second crossbeams and the second bunk to the first and second crossbeams.

The present invention may also be embodied as a method of supporting first and second bunks to a watercraft lift comprising a first support defining first and second legs, a second support defining third and fourth legs, and first and second bunks, the method comprising the following steps. First and second crossbeams are provided. The first crossbeam is pivotably connected to the first and second legs, and the second crossbeam is pivotably connected to the third and fourth legs. The first bunk is detachably attached to the first and second crossbeams, and the second bunk is detachably attached to the first and second crossbeams.

The present invention may also be embodied as a bunk mounting system for a watercraft lift comprising first, second, third, and fourth mounting locations, the bunk mounting system comprising first and second crossbeams, first, second, third, and fourth pivot connectors, and first, second, third, and fourth rail connectors. The first pivot connector pivotably connects the first crossbeam to the first mounting location. The second pivot connector pivotably connects the second crossbeam to the second mounting location. The third pivot connector pivotably connects the third crossbeam to the third mounting location. The fourth pivot connector pivotably connects the fourth crossbeam to the fourth mounting location. The first rail connector rigidly connects the first bunk to the first crossbeam. The second rail connector rigidly connects the first bunk to the second crossbeam. The third rail connector rigidly connects the second bunk to the first crossbeam. The fourth rail connector rigidly connects the second bunk to the second crossbeam.

DETAILED DESCRIPTION

Figure 1:
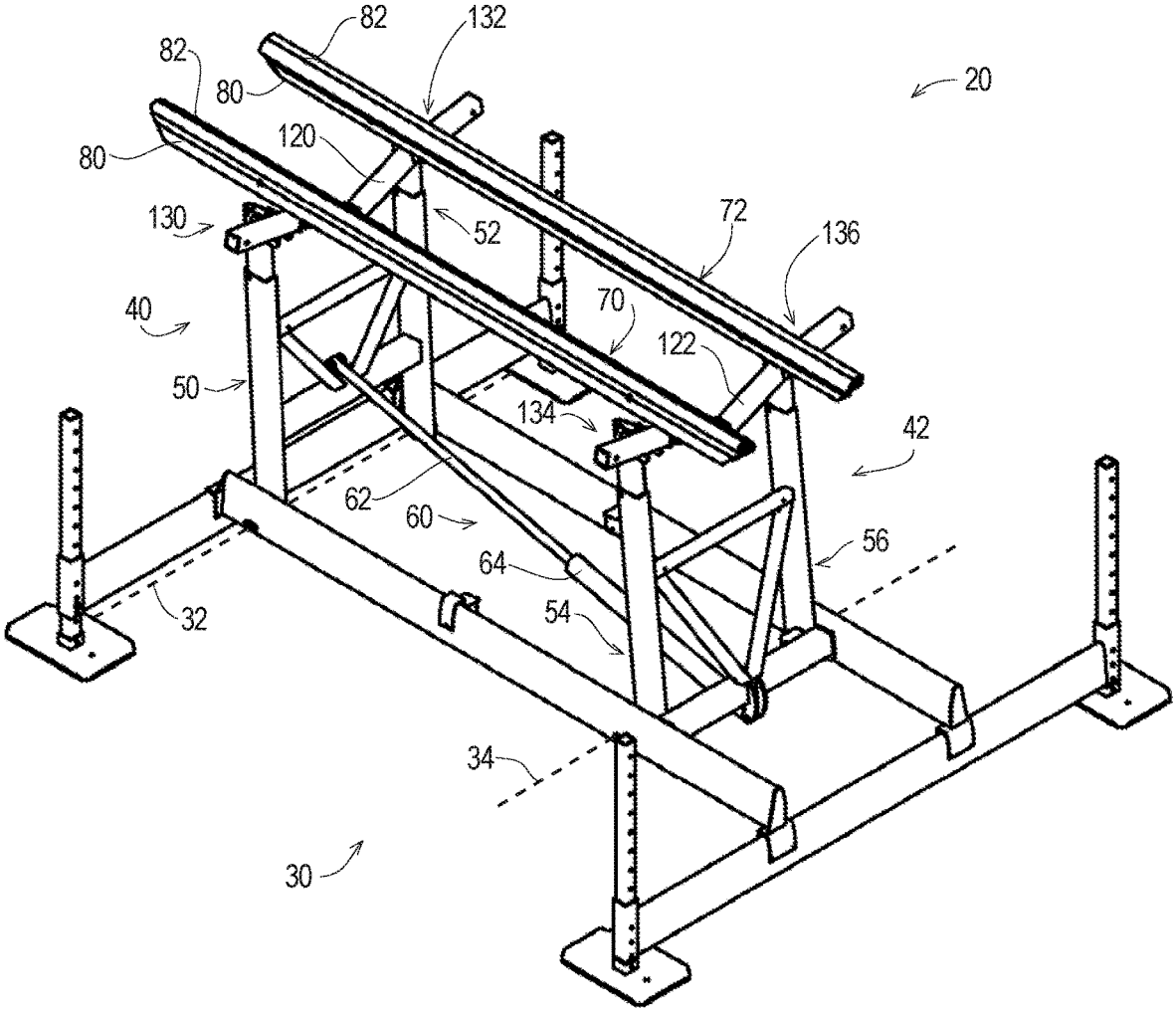
FIG. 1 is a perspective view of an example watercraft lift employing a first example bunk mounting system of the present invention, the example watercraft lift being shown in a fully raised configuration.

Referring initially to FIG. 1 of the drawing, depicted therein is an example watercraft lift 20 employing a first example bunk mounting system 22 constructed in accordance with, and embodying, the present invention. The example watercraft lift 20 is or may be conventional and will be described herein only to that extent necessary for a complete understanding of the first example bunk mounting system 22 of the present invention. Further, the first example bunk mounting system 22 of the present invention may be used with watercraft lifts other than the example watercraft lift 20.

The example watercraft lift 20 comprises a frame 30 defining first and second pivot axes 32 and 34. The example pivot axes 32 and 34 are parallel to each other, and a frame reference plane F extends through the pivot axes 32 and 34. During normal use of the watercraft lift 20, the example frame reference plane is substantially horizontal.

The example frame 30 supports first and second support assemblies 40 and 42 for rotation about the first and second pivot axes 32 and 34, respectively. The example first support assembly 40 comprises first and second leg assemblies 50 and 52, and the example second support assembly 42 comprises third and fourth leg assemblies 54 and 56. The example leg assemblies 50, 52, 54, and 56 are adjustable in length, but the present invention may be implemented using different configurations of the support assemblies and non-adjustable leg assemblies.

An actuator assembly 60 is operatively connected between the first and second support assemblies 40 and 42. In the example watercraft lift 20, operation of the actuator assembly 60 causes the first and second support assemblies 40 and 42 to pivot about the first and second pivot axes 32 and 34. In particular, a piston rod 62 of the actuator assembly 60 is connected to the first support assembly 40 above the reference plane, and a cylinder 64 of the actuator assembly 60 is connected to the second support assembly 42 below the reference plane.

The frame 30 is configured to rest on a bed (not shown) of a body of water (not shown). Extension of the rod 62 out of the cylinder 64 causes the support assemblies 40 and 42 to pivot away the frame 30, and retraction of the rod 62 into the cylinder 64 causes the support assemblies 40 and 42 to pivot towards the frame 30.

The example watercraft lift 20 comprises first and second bunk assemblies 70 and 72. Each of the bunk assemblies 70 and 72 comprises a rail 80 and a pad 82. The rails 80 are sized, dimensioned, and configured to extend between the first and second support assemblies 40 and 42 and to support a watercraft (not shown). The pads 82 are supported by the rails 80 to define a resilient surface that comes into contact with the supported watercraft to reduce the likelihood of damage to the watercraft lift 20 and/or watercraft when the watercraft is loaded onto, unloaded from, or supported by the watercraft lift 20.

Figure 2:
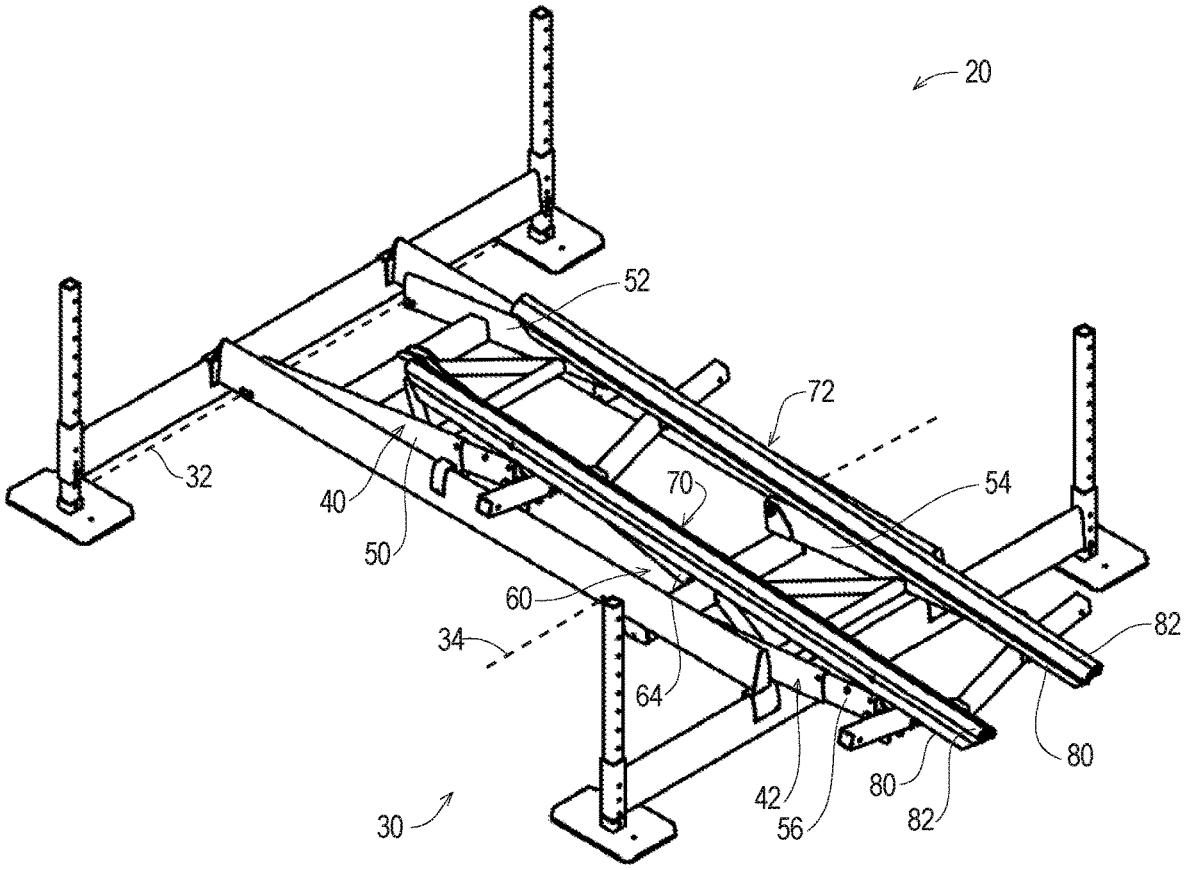
FIG. 2 is a perspective view of the example watercraft lift employing the first example bunk mounting system of the present invention, the example watercraft lift being shown in a fully lowered configuration.

Accordingly, when the support assemblies 40 and 42 are pivoted away from the frame 30 (e.g., FIGS. 1 and 3), the watercraft rests on the bunk assemblies 70 and 72 and is supported above the body of water in which the example watercraft lift 20 is located. When the support assemblies 40 and 42 are pivoted towards the frame 30 (e.g., FIGS. 2 and 5), the bunk assemblies 70 and 72 lower the watercraft until the watercraft is buoyantly supported by the water. The watercraft may be piloted away from the watercraft lift 20 when buoyantly supported by the water.

Figure 3:
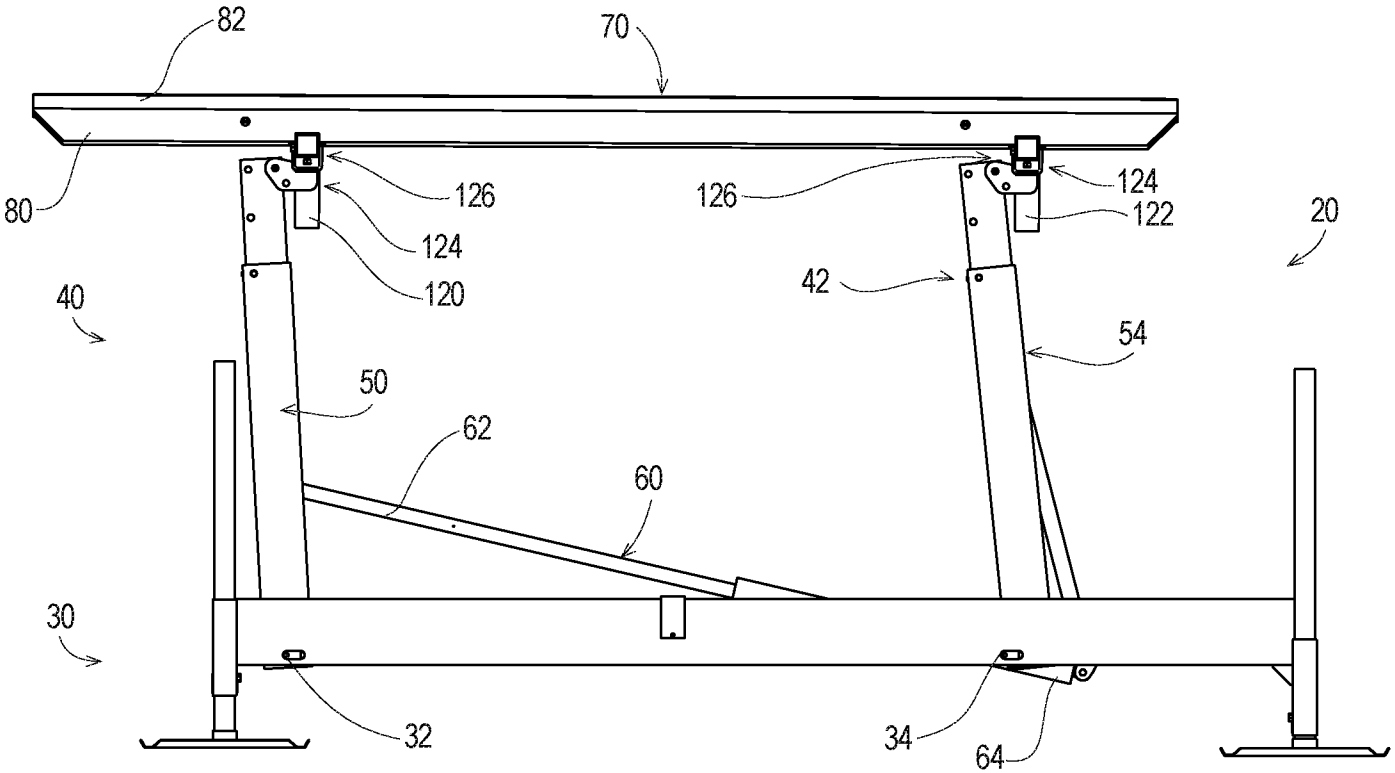
FIG. 3 is a side elevation view of the example watercraft lift employing the first example bunk mounting system of the present invention, the example watercraft lift being shown in a fully raised configuration.
Figure 4:
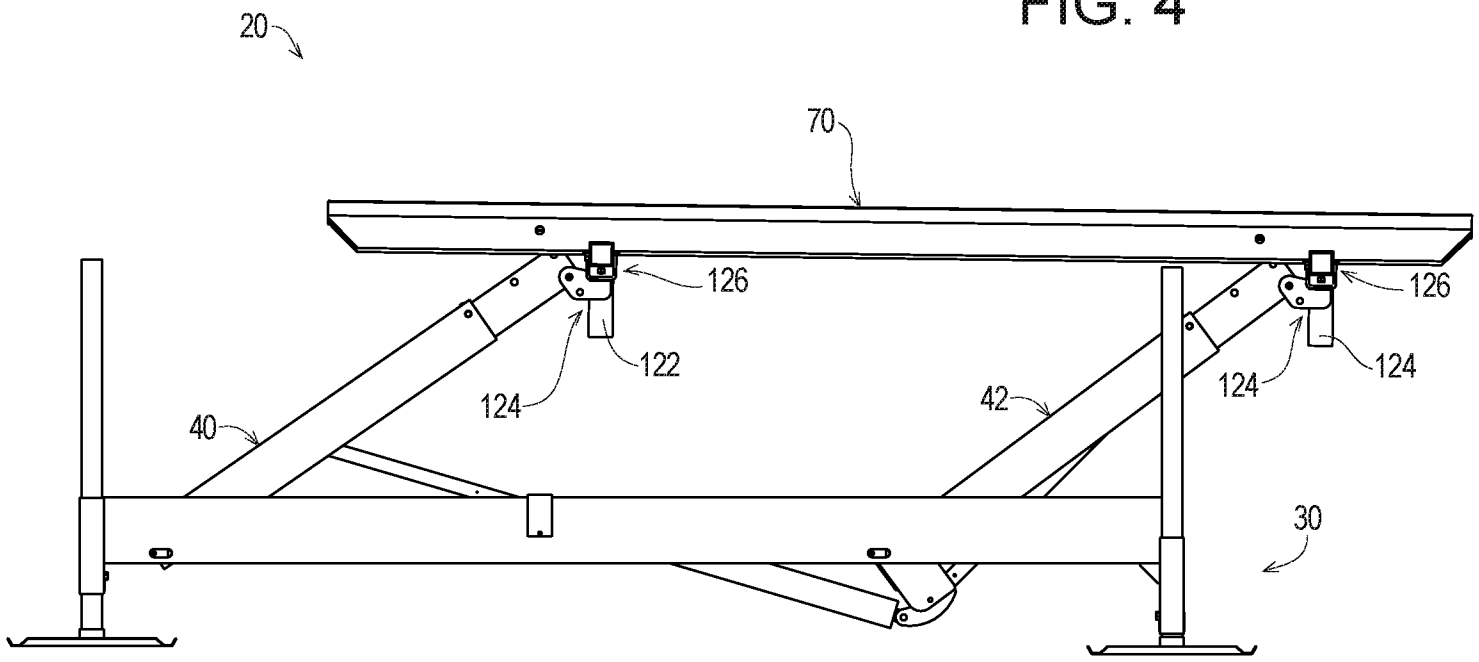
FIG. 4 is a side elevation view of the example watercraft lift employing the first example bunk mounting system of the present invention, the example watercraft lift being shown in an intermediate configuration between the fully raised configuration and the fully lowered configuration.
Figure 5:
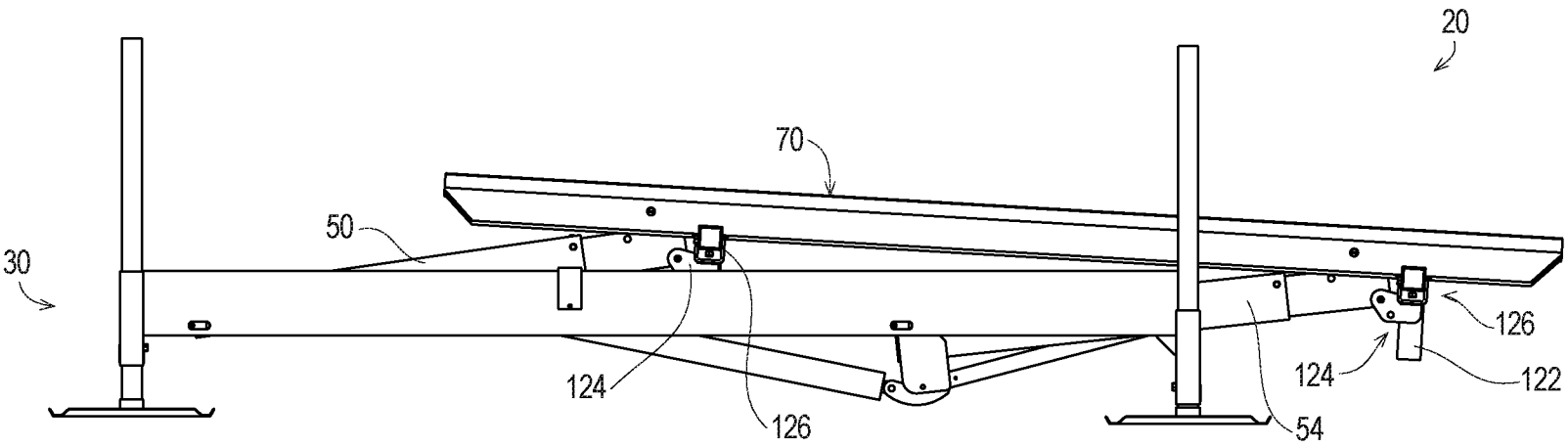
FIG. 5 is a side elevation view of the example watercraft lift employing the first example bunk mounting system of the present invention, the example watercraft lift being shown in a fully lowered configuration.

As perhaps best shown in FIGS. 3-5, the example bunk mounting system 22 comprises first and second crossbeams 120 and 122, a plurality of pivot connectors in the form of pivot connecting assemblies 124, and a plurality of rail connectors in the form of rail connecting assemblies 126. The pivot connecting assemblies 124 connect the first crossbeam 120 to the first support assembly 40 and the second crossbeam 122 to the second support assembly 42. As will be described in further detail below, the pivot connecting assemblies 124 allow rotation of the support assemblies 40 and 42 relative to the crossbeams 120 and 122 supported thereby.

The example rail connecting assemblies 126 rigidly support the rails 80 such that the bunk assemblies 70 and 72 extend between the crossbeams 120 and 122. In particular, the rail connecting assemblies 126 rigidly connect the rails 80 to the first and second crossbeams 120 and 122. The pivot connecting assemblies 124 allow the first and second crossbeams 120 and 122 to pivot relative to the support assemblies 40 and 42 as the actuator assembly 60 rotates the support assemblies 40 and 42 between the fully raised (FIGS. 1 and 3) and fully lowered (FIGS. 2 and 5) positions. Accordingly, as can be seen by a comparison of FIGS. 3, 4, and 5, the bunk assemblies 70 and 72 remain substantially coplanar as the actuator assembly 60 rotates the support assemblies 40 and 42 between the fully raised and fully lowered positions.

Figure 6:
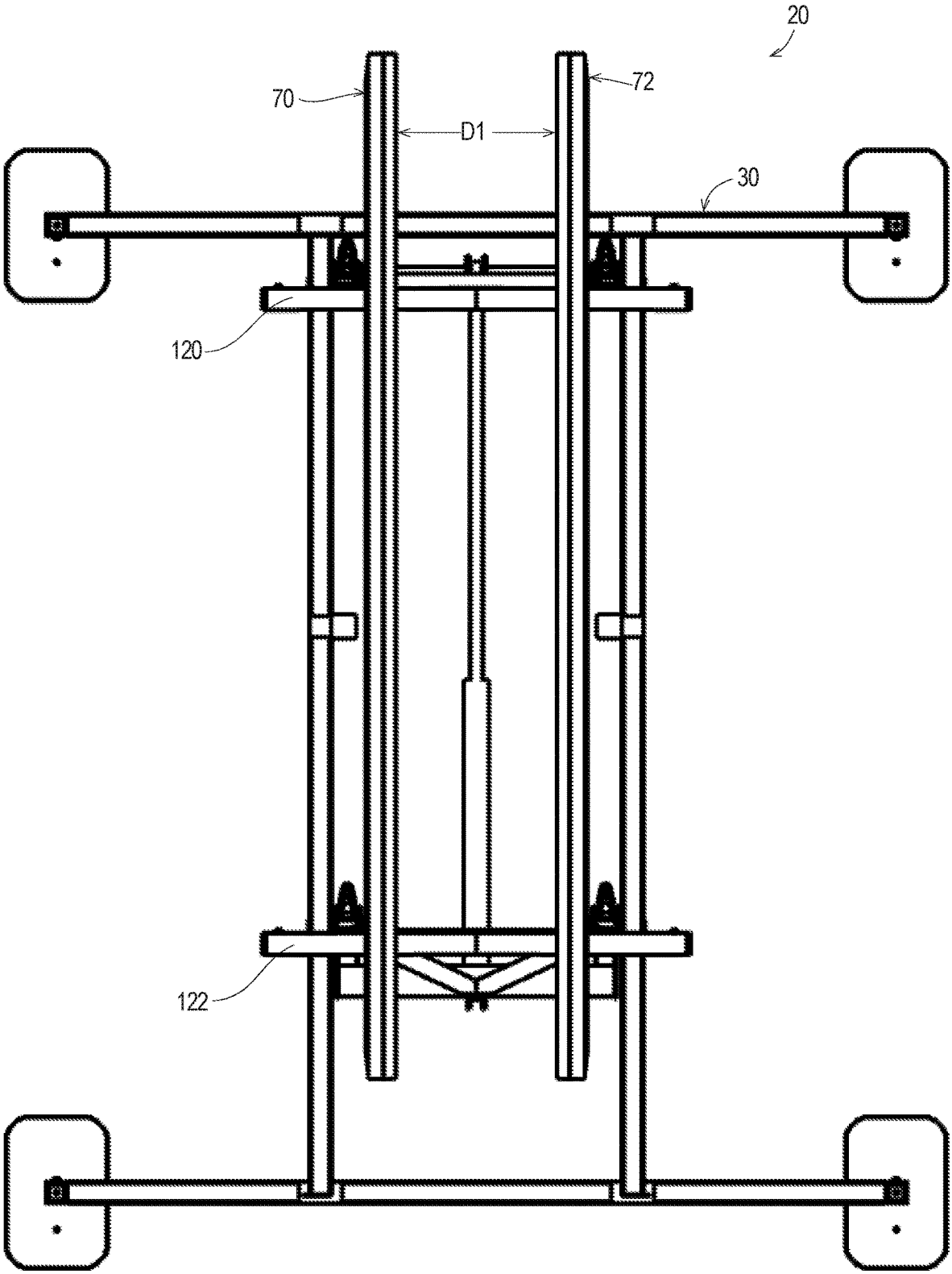
FIG. 6 is a top plan view of the example watercraft lift employing the first example bunk mounting system of the present invention, the first example bunk mounting system being shown in a first configuration.
Figure 7:
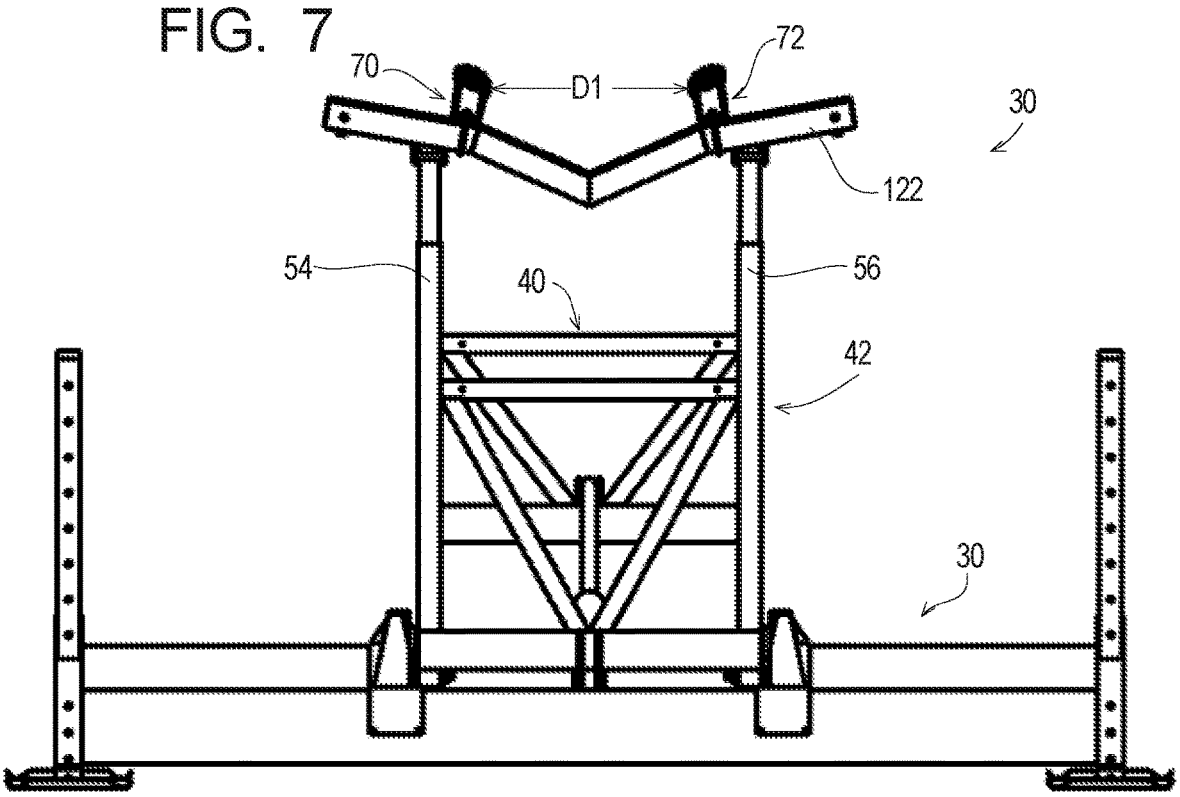
FIG. 7 is an end elevation view of the example watercraft lift employing the first example bunk mounting system of the present invention, the first example bunk mounting system being shown in a first configuration.
Figure 8:
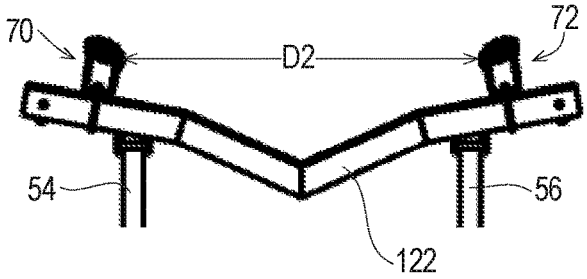
FIG. 8 is an end elevation view of a portion of the example watercraft lift employing the first example bunk mounting system of the present invention, the first example bunk mounting system being shown in a second configuration.
Figure 9:
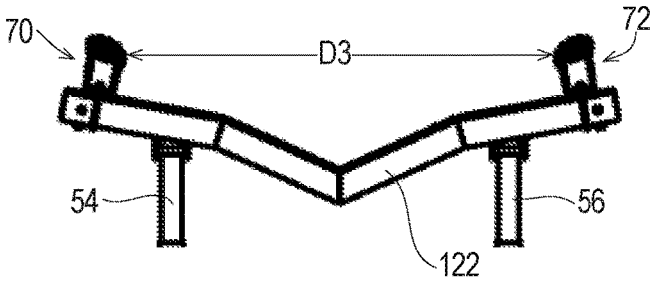
FIG. 9 is an end elevation view of a portion of the example watercraft lift employing the first example bunk mounting system of the present invention, the first example bunk mounting system being shown in a third configuration.
Figure 10:
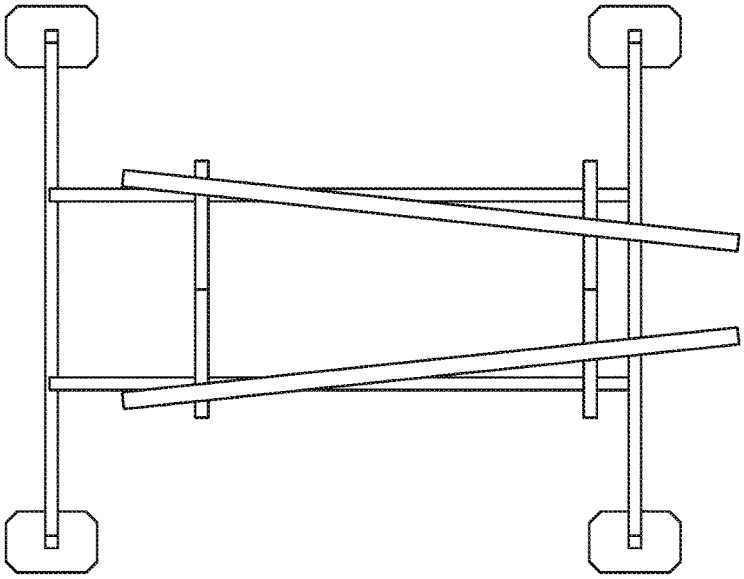
FIG. 10 is to plan view of the example watercraft lift employing the first example bunk mounting system of the present invention, the first example bunk mounting system being shown in a fourth configuration.

FIGS. 6-10 illustrate that the first example bunk mounting system allows the bunk assemblies 70 and 72 to be arranged in a plurality of different configurations relative to each other and to the support assemblies 40 and 42. FIGS. 6 and 7 illustrate a first configuration in which the bunk assemblies 70 and 72 are parallel to and spaced a distance D1 from each other. FIG. 8 illustrates a second configuration in which the bunk assemblies 70 and 72 are parallel to and spaced a distance D2 from each other, with D2 being greater than D1. FIG. 9 illustrates a third configuration in which the bunk assemblies 70 and 72 are parallel to and spaced a distance D3 from each other, with D3 being greater than D2. FIG. 10 illustrates a fourth configuration in which the bunk assemblies 70 and 72 are angled with respect to each other. The desired distance and/or angular relationship between the bunk assemblies 70 and 72 is calculated based on characteristics of the load (e.g. boat) supported by the example watercraft lift 20.

Referring now to FIGS. 11-15, examples of the crossbeams 120 and 1212, the pivot connecting assemblies 124, and the rail connecting assemblies 126 that may be used as part of the first example bunk mounting system 22 will be described.

Figure 13:
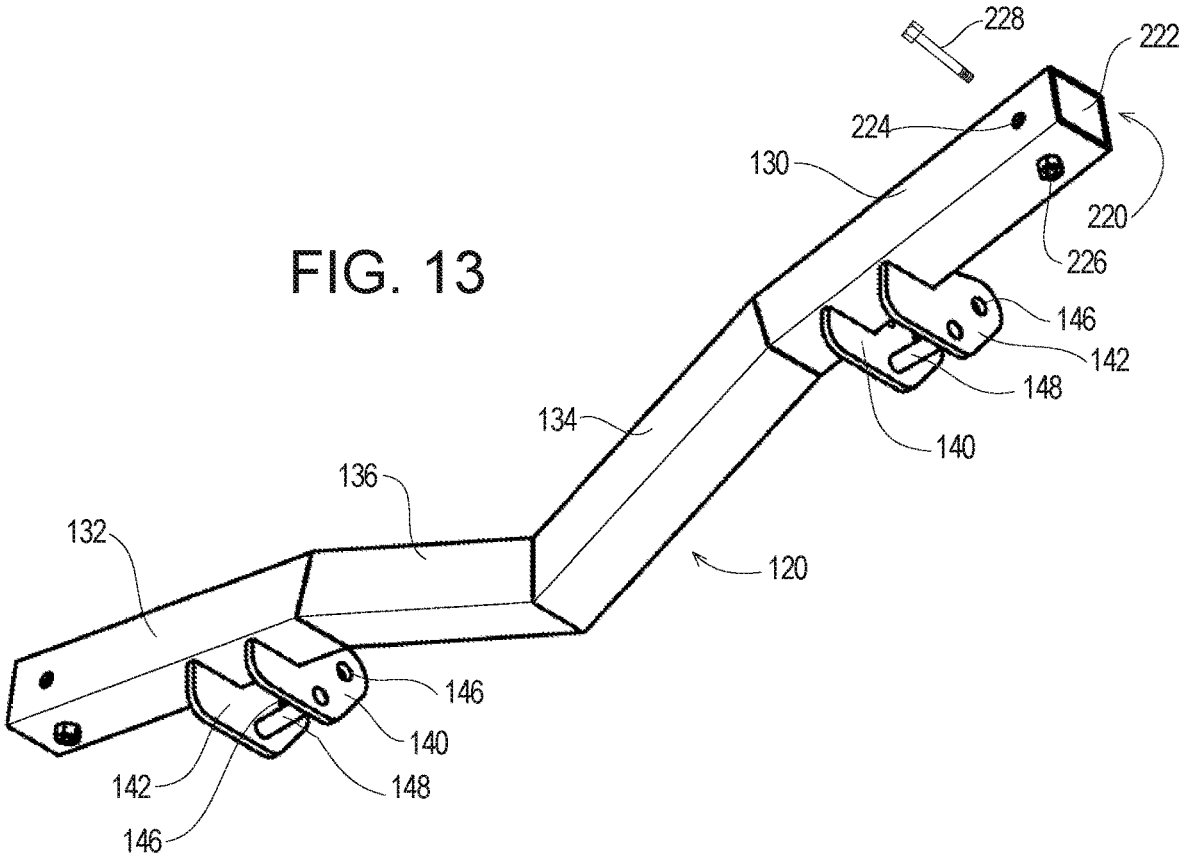
FIG. 13 is a lower perspective view of an example crossbeam that may be used by the first example bunk mounting system.

The example crossbeams 120 and 122 are the same, and only the example crossbeam 120 will be described herein in detail. However, it should be understood that the crossbeams 120 and 122 need not be the same to implement the principles of the present invention. FIG. 13 of the drawing illustrates that the example crossbeam 120 comprises first and second outer sections 130 and 132 and first and second inner sections 134 and 136. When the crossbeams 120 and 122 are supported by the example watercraft lift 20, the first and second outer sections 130 and 132 extend at first and second angles, respectively, relative to the frame reference plane and first and second inner sections 134 and 136 extend at third and fourth angles, respectively, relative to the frame reference plane. The first and second angels are substantially the same as each other, the third and fourth angles are substantially the same as each other, and the first and second angles are less than the third and fourth angles.

The inner sections 134 and 136 of the crossbeams 120 and 122 thus take the form of a V, with the outer sections 130 and 132 extending laterally outwardly from the outer ends of the V formed by the inner sections 134 and 136. In use, the inner sections 134 and 136 are arranged to provide clearance for a V-shaped hull of the watercraft, and the outer sections 130 and 132 extend laterally from the centerline of the watercraft to accommodate a desired configuration of bunk assemblies 70 and 72. The outer sections 130 and 132, which extend laterally from the centerline of the watercraft, are further configured to accommodate a desired configuration of accessories as will be described in further detail below.

Referring now to FIGS. 11 and 13-15, the example pivot connecting assemblies 124 will now be described in further detail. The example pivot connecting assemblies 124 each comprise first and second flanges 140 and 142 rigidly connected to the example crossbeam 120 and a pivot pin 144. The pivot pin extends between pivot openings 146 formed in the first and second flanges 140 and 142, respectively. An optional stop pin 148 is rigidly connected between the first and second flanges 140 and 142.

Figure 14:
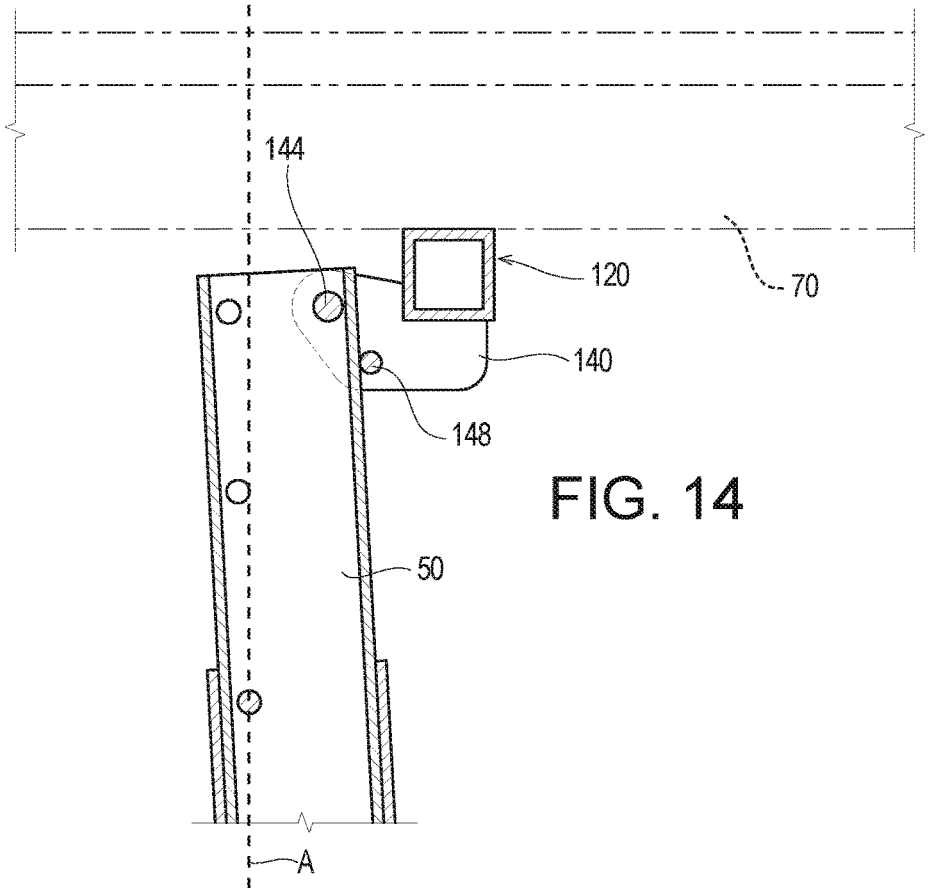
FIG. 14 is a section view illustrating the engagement of the example crossbeam of the first example bunk mounting system with a support assembly of the example watercraft lift, the example watercraft lift being shown in a fully raised configuration.
Figure 15:
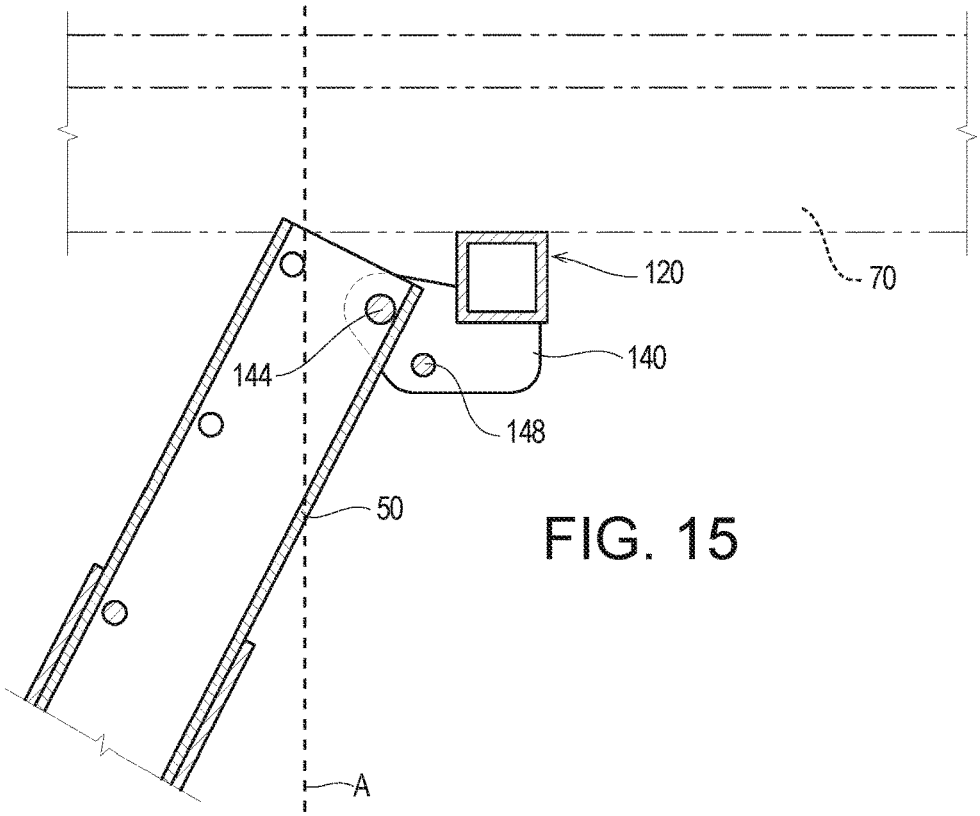
FIG. 15 is a section view illustrating the engagement of the example crossbeam of the first example bunk mounting system with a support assembly of the example watercraft lift, the example watercraft lift being shown in an intermediate configuration.

In use, the pivot openings 146 and 148 are aligned with support openings not visible in one of the leg assemblies 50, 52, 54, and 56 (the leg assembly 50 is shown in FIGS. 14 and 15) and the pivot pin 144 is inserted through the aligned openings. The pivot pin 144 allows rotation of the crossbeams 120 and 122 relative to the leg assemblies 50, 52, 54, and 56 as shown by a comparison of FIGS. 14 and 15.

More specifically, the pivot pin 144 allows the crossbeams 120 and 122 to remain such that the V defined by the inner portions 134 and 136 is pointed down during movement of the support assemblies 40 and 42 between the fully raised and fully lowered positions. When the support assemblies 40 and 42 are in the lower positions and during movement of the support assemblies 40 and 42 from the lower position to the upper position as shown in FIG. 15, the stop pin 148 does not engage the leg assembly 50. However, when the leg assembly 50 goes slightly past vertical, as shown with reference to plane A in FIG. 14, the stop pin 148 engages the leg assembly 50 to prevent further rotation of the crossbeam 120. When the stop pin 148 engages the leg assembly 50, the example watercraft 20 is locked in its fully raised configuration.

Other pivot connecting assemblies may be used in addition to or instead of the example connecting assemblies 124 when implementing the principles of the present invention.

Figure 12:
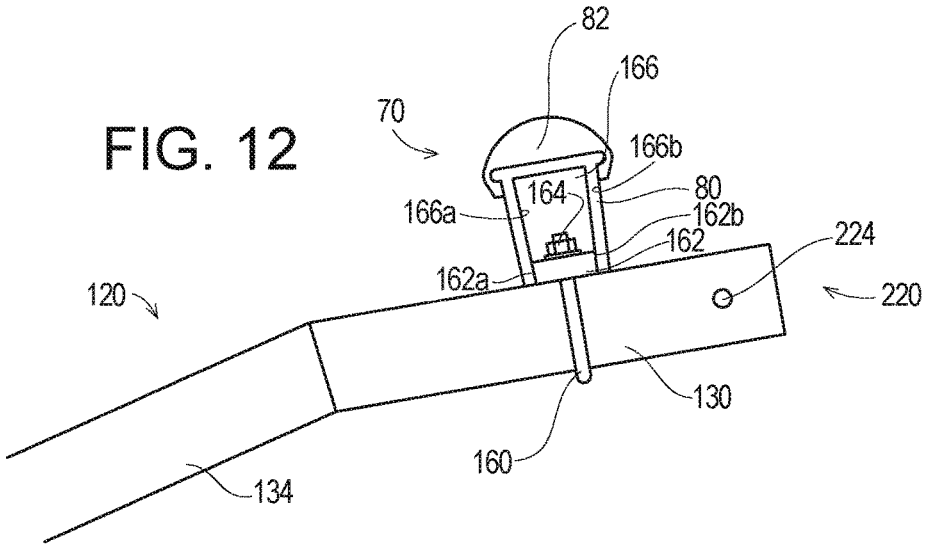
FIG. 12 is an end elevation view of a portion of the first example bunk mounting system.

Referring now to FIG. 12 of the drawing, the example rail connecting assemblies 126 will be described in further detail. The example rail connecting assemblies 126 comprise a U-bolt 160, a connecting plate 162, and nuts 164. The connecting plate 162 is arranged within a rail channel 166 defined by the rail 80 and may be rigidly connected to rail 80. The U-bolt 160 is sized and dimensioned to extend around the crossbeam 120 and through holes (not shown) in the connecting plate 162.

With the U-bolt 160 extending around the crossbeam 120 and through the holes in the connecting plate 162, the nuts 164 are engaged with the U-bolt 160 and tightened such that the U-bolt 160 clamps the crossbeam 120 to the underside of the rail 80. This clamping force inhibits relative movement of the rail 180 relative to the crossbeam 120 during normal use of the example watercraft lift 20. To adjust a location of the rails 80 relative to the crossbeams 120 and 122, the nuts 164 may be loosened to release the clamping force, the rails 80 are slid into the desired position relative to the crossbeams 120 and 122, and the nuts 164 are tightened reapply the clamping force. For certain adjustments (e.g., one side of the leg assembly to the other), it may be necessary to remove the U-bolt 160 from the connecting plate 162.

In place of the U-bolt 160, a straight bolt may be used, in which case the straight bolt would be inserted through holes holes formed in the crossbeams 120 and 122 and the rails 80. The holes in the crossbeams 120 and 122 would define the positions at which the rails 80 may be fixed relative to the crossbeams 120 and 122.

In addition, the connecting plate 162 may be rigidly attached to the rail 80 at any one of a continuum or a plurality of locations along the rail channel 166. The example rail connecting assemblies 126 thus allows the rail 80 to be moved forward and aft relative to the crossbeams 120 and 122 such that the rails 80 are in a desired position relative to the crossbeams 120 and 122 based on a configuration of the boat (not shown) supported by the watercraft lift 20. Based on the characteristics of the load (e.g., boat), a desired position of the rails 80 relative to the crossbeams 120 and 122 is determined. The desired forward/aft position of the rails 80 relative to the crossbeams 120 and 122 thus allows further adjustment of the position of the load (e.g., boat) on the rails 80 relative to the crossbeams 120 and 122.

Further, as shown in FIG. 12, the example channel 166 of the rail 80 is defined by inwardly angled inner surfaces **166*a* and 166*b* of the rail 80. The example connecting plate 162 defines angled outer surfaces 162*a* and 162*b* that are complementary to the angled inner surfaces 166*a* and 166*b*. Loosening of the nuts 164 allows the connecting plate 162 to be displaced away from the U-bolt 160 such that the angled outer surfaces 162*a* and 162*b* are disengaged from the angled inner surfaces 166*a* and 166*b* to allow movement of the rail 80 relative to the crossbeams 120 and 122. On the other hand, tightening of the nuts 164 displaces the connecting plate 162 toward the U-bolt 160 such that the angled outer surfaces 162*a* and 162*b* both frictionally and mechanically engage the angled inner surfaces 166*a* and 166*b* to inhibit movement of the rail 80 relative to the crossbeams 120 and 122**.

Other rail connecting assemblies may be used in addition to or instead of the example rail assemblies 126 when implementing the principles of the present invention.

Figure 11:
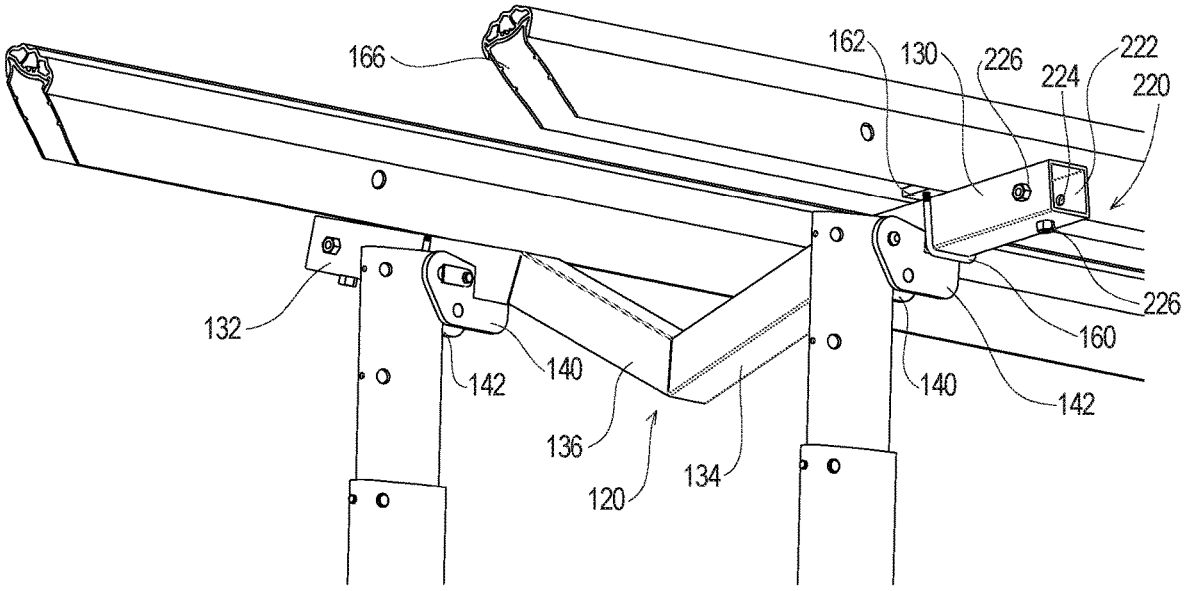
FIG. 11 is a lower perspective view of a portion of the first example bunk mounting system when the example watercraft lift is in the fully raised configuration.
Figure 16:
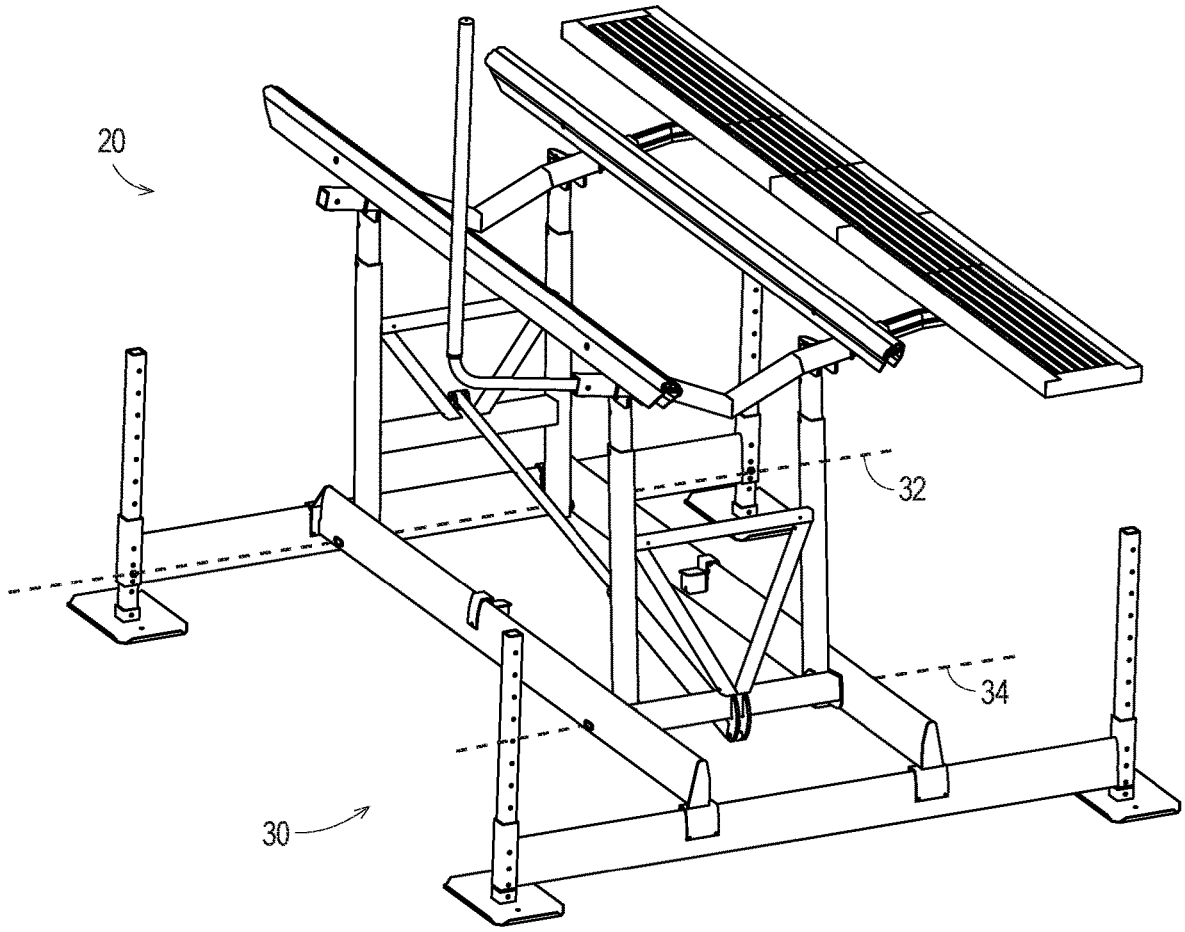
FIG. 16 is a perspective view of the example watercraft lift employing the first example bunk mounting system of the present invention, the example watercraft lift being shown in a fully raised configuration and the first example bunk mounting system shown supporting first and second accessories.
Figure 17:
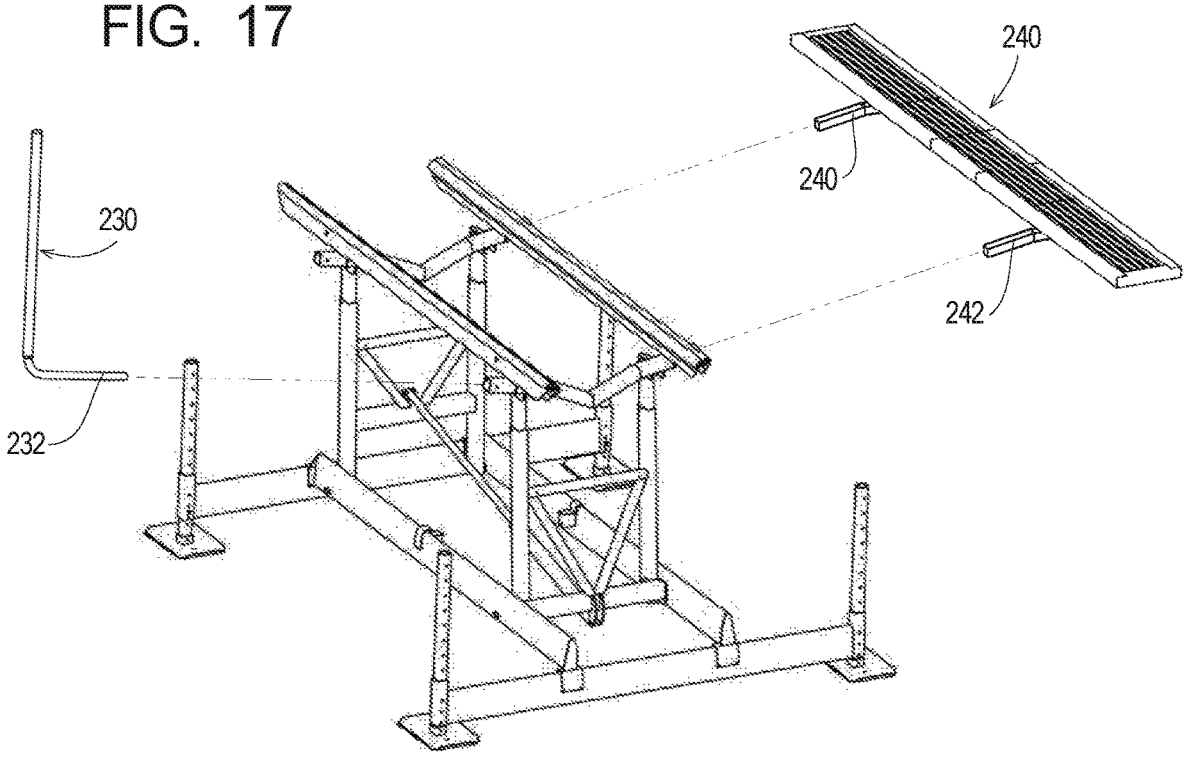
FIG. 17 is a perspective view of the example watercraft lift employing the first example bunk mounting system of the present invention, the example watercraft lift being shown in a fully raised configuration and the first and second accessories detached from the first example bunk mounting system.

Turning now to FIGS. 11, 16, and 17, it can be seen that the outer sections 130 and 132 of the crossbeams 120 and 122 can be used to mount accessories to the example watercraft lift 20. FIG. 11 illustrates that the outer sections 130 and 132 are hollow and each define an accessory connection system 220 at a distal end thereof. FIG. 11 illustrates that the accessory connection system 220 comprises an accessory opening 222 and, optionally, retaining openings 224, retaining nuts 226, and a retaining pin 228 (FIG. 13).

FIGS. 16 and 17 show that a guide rod 230 defining a connecting end 232 may be attached to one of the outer sections 130 or 132 of the crossbeams 120 or 122. The connecting end 232 is sized and dimensioned to snugly fit within the accessory opening 222. A lock pin 228 may be inserted through the retaining openings 224 to secure the connecting end 232 within the accessory opening. The lock pin 228 may be a detent pin or may be threaded to engage the optional retaining nut 226.

FIGS. 16 and 17 show that catwalk 240 defining first and second connecting ends 242 and 244 may be attached to the outer sections 130 or 132 of a pair of the crossbeams 120 and 122. The connecting ends 242 and 244 are sized and dimensioned to snugly fit within the accessory openings 222 of the crossbeams 120 and 122. A lock pin (not shown) may be inserted through the retaining openings 224 to secure the connecting ends 242 and 244 within the accessory openings 224. The lock pin 228 may be a detent pin or may be threaded to engage the optional retaining nut 226.

What is claimed is:

1. A bunk mounting system for a watercraft lift comprising:

a first support including first and second leg assemblies;

a second support including third and fourth leg assemblies;

first and second crossbeams;

a plurality of pivot connectors connecting the first crossbeam to the first and second leg assemblies to enable rotational movement of the first crossbeam relative to the first and second leg assemblies, and connecting the second crossbeam to the third and fourth leg assemblies to enable rotational movement of the second crossbeam to the third and fourth leg assemblies, each of the plurality of pivot connectors including:

a first flange;

a second flange;

a pivot pin coupled to the first and second flanges through a corresponding one of the leg assemblies; and a stop pin coupled to the first and second flanges and extending between the first and second flanges, the stop pin configured to engage the corresponding one of the leg assemblies to limit rotation of a corresponding one of the first and second crossbeams relative to the corresponding one of the leg assemblies;

a first bunk;

a second bunk;

a plurality of rail connectors detachably connecting the first bunk to the first and second crossbeams and the second bunk to the first and second crossbeams, wherein each of the first and second leg assemblies include a first leg and a second leg coupled together in a telescopic arrangement, the first leg coupled to the first crossbeam by one of the plurality of pivot connectors, the first leg having an adjustable height relative to the second leg, and wherein each of the third and fourth leg assemblies include a first leg and a second leg coupled together in a telescopic arrangement, the first leg coupled to the second crossbeam by one of the plurality of pivot connectors, the first leg having an adjustable height relative to the second leg.

2. The bunk mounting system of claim 1, wherein each rail connector comprises a bolt configured to fix a location of one of the first and second bunks relative to one of the first and second crossbeams.

3. The bunk mounting system of claim 2, wherein the bolt comprises a U-bolt adapted to clamp the one of the first and second bunks to the one of the first and second crossbeams.

4. The bunk mounting system of claim 2, wherein the first and second bunks include first openings and the first and second crossbeams include second openings, the bolt comprising a straight bolt adapted to extend through one of the first openings in one of the first and second bunks and a corresponding one of the second openings in one of the first and second crossbeams.

5. The bunk mounting system of claim 1, wherein each rail connector comprises:

a connecting plate; and a U-bolt coupled to the connecting plate, wherein the connecting plate engages one of the first and second bunks, and the U-bolt extends at least partly around one of the first and second crossbeams to fix a location of one of the first and second bunks relative to one of the first and second crossbeams.

6. The bunk mounting system of claim 1, further comprising at least one accessory removably coupled to at least one of the first and second crossbeams.

7. The bunk mounting system of claim 6, wherein the at least one accessory includes at least one guide rod that has a connecting end sized and shaped to fit within at least one of the first and second crossbeams, the bunk mounting system further comprising:

a lock pin that engages the connecting end of the at least one guide rod and the one of the first and second crossbeams to secure the at least one guide rod to the one of the first and second crossbeams.

8. The bunk mounting system of claim 6, wherein the at least one accessory is a catwalk including first and second connecting ends, where the first and second connecting ends are sized and shaped to fit within the first and second crossbeams, respectively, the bunk mounting system further comprising:

first and second lock pins that engage the first and second crossbeams and the first and second connecting ends of the catwalk, respectively, to secure the catwalk to the first and second crossbeams.

9. The bunk mounting system of claim 1 wherein each of the plurality of pivot connectors includes the stop pin spaced and offset from the pivot pin, such that the stop pin is configured to engage the corresponding one of the leg assemblies with the corresponding one of the leg assemblies being past vertical.

10. The bunk mounting system of claim 1 wherein the first flange includes a top edge and a left edge having an outermost portion in a lateral direction, the stop pin spaced further from the top edge in a longitudinal direction and the outermost portion of the left edge in the lateral direction than the pivot pin.

11. A method of adjusting first and second bunks relative to a watercraft lift comprising a first support including first and second leg assemblies, a second support including third and fourth leg assemblies, and a first bunk and a second bunk, the method comprising:

adjusting a lateral position of the first bunk and the second bunk relative to a first crossbeam coupled to the first support and a second crossbeam coupled to the second support until the first bunk and the second bunk are spaced by a distance corresponding to characteristics of a load to be supported on the first bunk and the second bunk, adjusting the lateral position of the first bunk and the second bunk including sliding bolts coupled to the first and second bunks and the first and second crossbeams along the first and second crossbeams in a first direction and a second opposite direction;

adjusting the first bunk and the second bunk in a longitudinal direction relative to the first and second crossbeams to a longitudinal position corresponding to a weight distribution of the load to be supported on the first bunk and the second bunk, including adjusting the first bunk and the second bunks front to back relative to the watercraft lift and the first and second crossbeams, adjusting the first bunk and the second bunk in the longitudinal direction further including:

loosening a plurality of nuts connected to the bolts coupled to the first and second crossbeams and connecting plates, the connecting plates received within a rail channel internal to the first and second bunks;

adjusting the first and second bunks in the longitudinal direction, including sliding the first and second bunks front to back relative to the connecting plates; and tightening the plurality of nuts; and adjusting a height of the first bunk and the second bunk relative to the first support and the second support, adjusting the height of the first bunk and the second bunk including:

adjusting a height of a first leg of each of the first and second leg assemblies coupled to the first crossbeam relative to a second leg of each of the first and second leg assemblies coupled to the first leg in a telescopic arrangement; and adjusting a height of a first leg of each of the third and fourth leg assemblies coupled to the second crossbeam relative to a second leg of each of the first and second leg assemblies coupled to the first leg in a telescopic arrangement.

12. The method of claim 11 wherein adjusting the lateral position of the first and the second bunk relative to the first crossbeam and the second crossbeam includes positioning a first end of the first bunk at a first lateral distance along the first crossbeam from a first end of the second bunk and positioning a second end of the first bunk at a second lateral distance along the second crossbeam from a second end of the second bunk, wherein the first lateral distance is greater than the second lateral distance.

13. A bunk mounting system for a watercraft lift comprising:

a support assembly;

a first crossbeam having an open end;

a second crossbeam;

at least one accessory having a connecting end configured to be received within the open end of the first crossbeam to couple the at least one accessory to the first crossbeam;

a plurality of pivot connectors connecting the first crossbeam and the second crossbeam to the support assembly to enable rotation of the first and second crossbeams relative to the support assembly;

a first bunk having a first end and a second end;

a second bunk having a first end and a second end;

a first rail connector connecting the first bunk to the first crossbeam, the first rail connector configured to enable adjustment of a lateral position and a longitudinal position of the first end of the first bunk relative to the first crossbeam;

a second rail connector connecting the first bunk to the second crossbeam, the second rail connector configured to enable adjustment of a lateral position and a longitudinal position of the second end of the first bunk relative to the second crossbeam;

a third rail connector connecting the second bunk to the first crossbeam, the third rail connector configured to enable adjustment of a lateral position and a longitudinal position of the first end of the second bunk relative to the first crossbeam; and a fourth rail connector connecting the second bunk to the second crossbeam, the fourth rail connector configured to enable adjustment of a lateral position and a longitudinal position of the second end of the second bunk relative to the second crossbeam.

14. The bunk mounting system of claim 13, wherein each of the plurality of pivot connectors comprises:

a pair of flanges;

a pivot pin coupled to the pair of flanges and the support assembly; and a stop pin coupled to the pair of flanges and extending between the pair of flanges, the stop pin configured to engage the support assembly to limit rotation of the first and second crossbeams relative to the support assembly.

15. The bunk mounting system of claim 13, wherein each of the plurality of rail connectors comprises a bolt configured to fix a location of one of the first and second bunks relative to one of the first and second crossbeams.

16. The bunk mounting system of claim 13, wherein the first bunk and the second bunk each include a rail channel internal to the first and second bunks, each rail connector further comprising:

a connecting plate received in the rail channel within one of the first and second bunks, the first and second bunks configured to slide relative to the connecting plate; and a U-bolt coupled to the connecting plate, wherein the U-bolt extends at least partly around one of the first and second crossbeams to fix a location of one of the first and second bunks relative to one of the first and second crossbeams.

17. The bunk mounting system of claim 13, wherein the at least one accessory is at least one guide rod having the connecting end, the bunk mounting system further comprising:

a lock pin that engages the connecting end of the at least one guide rod and the first crossbeam to secure the at least one guide rod to the first crossbeam.

18. The bunk mounting system of claim 13, wherein the at least one accessory is a catwalk including first and second connecting ends and the second crossbeam further includes an open end, where the first and second connecting ends are sized and shaped to be received within the open ends of the first and second crossbeams, respectively, the bunk mounting system further comprising:

first and second lock pins that engage the first and second crossbeams and the first and second connecting ends of the catwalk, respectively, to secure the catwalk to the first and second crossbeams.

19. The bunk mounting system of claim 13 wherein the first crossbeam and the second crossbeam include a bottom surface, the plurality of pivot connectors coupled to the bottom surface of the first and second crossbeams with the first and second crossbeams spaced from the support assembly across a width of each the plurality of pivot connectors, the plurality of pivot connectors further including a pivot pin and a stop pin spaced and offset from the pivot pin.

20. The bunk mounting system of claim 13 wherein the open end of the first crossbeam is a first open end, the first crossbeam having a second open end and the second crossbeam having an open end, and the at least one accessory includes a guide rod having the connecting end to be received within the first open end of the first crossbeam and a catwalk, including:

a first connecting end configured to be received within the second open end of the first crossbeam; and a second connecting end configured to be received within the open end of the second crossbeam.

21. The bunk mounting system of claim 20 wherein the connecting end of the guide rod is parallel with the first open end of the first crossbeam and the first and second connecting ends of the catwalk are parallel with the second open end of the first crossbeam and the open end of the second crossbeam, respectively.

* * * * *